US005475991A

United States Patent [19]

Yabuta et al.

[11] Patent Number: 5,475,991

[45] Date of Patent: Dec. 19, 1995

[54] SINKER MECHANISM FOR FLAT KNITTING MACHINES HAVING YARN DROP PREVENTION PART

[75] Inventors: Masahiro Yabuta; Minoru Kyotani, both of Wakayama, Japan

[73] Assignee: Shima Seiki Manufacturing Limited, Wakayama, Japan

[21] Appl. No.: 166,965

[22] Filed: Dec. 15, 1993

[30] Foreign Application Priority Data

Dec. 15, 1992 [JP] Japan ..... 4-334596

[51] Int. Cl.[6] ..... D04B 15/06

[52] U.S. Cl. ..... 66/106; 66/64; 66/109

[58] Field of Search ..... 66/104, 106, 107, 66/109, 110, 103, 105, 108 A, 114, 115, 60 R, 64, 90

[56] References Cited

U.S. PATENT DOCUMENTS

| | | | |
|---|---|---|---|
| 1,653,886 | 12/1927 | Billings | 66/106 |
| 5,134,864 | 8/1992 | Yabut et al. | 66/106 |
| 5,134,865 | 8/1992 | Shima et al. | 66/106 |
| 5,231,854 | 8/1993 | Schmid et al. | 66/64 |
| 5,280,712 | 1/1994 | Nakamori et al. | 66/106 |
| 5,333,473 | 8/1994 | Miyamoto | 66/106 |

FOREIGN PATENT DOCUMENTS

| | | |
|---|---|---|
| 0424717 | 5/1991 | European Pat. Off. . |
| 89/12708 | 12/1989 | WIPO . |
| 92/13126 | 8/1992 | WIPO . |

*Primary Examiner*—C. D. Crowder
*Assistant Examiner*—Larry D. Worrell, Jr.
*Attorney, Agent, or Firm*—Wenderoth, Lind & Ponack

[57] ABSTRACT

A sinker is disposed at the front end of a needle bed of a flat knitting machine so as to be capable of swinging displacement. A groove guiding advancing, retreating and swinging of the sinker is formed at the front end of the needle bed. A knitting yarn holding part is formed at the front end of a sinker plate. A knitting yarn drop preventive part, for preventing knitting yarn between a knitting needle and the sinker from dropping into the groove during knitting, is disposed adjacent to the sinker.

14 Claims, 15 Drawing Sheets

SINKER MECHANISM FOR FLAT KNITTING MACHINES HAVING YARN DROP PREVENTION PART

BACKGROUND OF THE INVENTION

1. Field of the Invention

The present invention relates to a sinker mechanism disposed at the front end of a needle bed of a flat knitting machine, provided with at least a pair of needle beds, on which a plurality of knitting needles are slidably mounted in parallel, and which are disposed oppositely in front and rear positions.

2. Description of Related Art

Prior art sinker mechanisms of the type disposed at a needle bed front end of a flat knitting machine are disclosed in U.S. Pat. No. 5,134,865 and International Publication WO 89/12708, and others have been known.

In the former such prior art arrangements, an approximately arc-shaped loop forming edge is formed on a main body of the sinker at the front end portion of the needle bed, and a knitting yarn holding part is formed forwardly thereof. A guide groove for guiding the sinker to move forwardly and rearwardly and to swing with respect to an opening is formed at the needle bed front end. When the sinker swings forwardly in the guide groove, the knitting yarn holding part is caused to swing into a deep position beneath the opening gap of the needle bed, and by pushing the sinker loop of the previous course, the loop of the previous course is prevented from floating with the knitting needle when the knitting needle advances. Thus, the loop may be formed continuously.

In the latter such prior art arrangement, on the other hand, a comb bed is placed above the front end of the needle bed, and a comb jack, which is capable of swinging movement, is pivoted in a wire stretched in the longitudinal direction of the needle bed above the comb bed. The comb jack comprises a lever for adjusting the extent of swinging movement by a cam provided in a carriage in a rear part, and an elastic leg for thrusting the comb jack in the stitch pushing direction. At a front end portion of the comb jack is formed a hole so that the comb jack can swing, with the wire stretched in the longitudinal direction of the comb bed being inserted. The comb jack swings, resisting the force of the elastic leg from pushing the stitch to a deep position, by the activation of the cam provided in the carriage, and is designed to apply a tension to the former loop, depending on the length of the stitch.

However, in U.S. Pat. No. 5,134,865, since knitting is performed in a state in which the gap between the sinker and the guide groove for guiding the swinging motion of the sinker is exposed on the needle bed, in a case of a fine gauge knitting machine with a small needle pitch, in a case of pulling the knitting needle largely with the sinker pushed into a deep position, or in a case of knitting a pattern in which the tension of the knitting yarn applied between the knitting needle and sinker is intensified, the knitting yarn may fall into and be broken in the gap between the sinker and the sinker guide groove, or other troubles might occur.

In WO 89/12708, since the wire is disposed in the longitudinal direction of a comb floor at the front end portion thereof, such problem does not occur. However, a hole for inserting the wire must be formed in the front end portion of the comb jack, and the thickness of the knitting yarn holding part of the sinker is reduced, thus causing a weakening of the strength thereof.

SUMMARY OF THE INVENTION

Considering the above problems, it is hence a primary object of the present invention to provide a sinker mechanism capable of sufficiently pushing the former loop without sacrificing the strength of the sinker, and to prevent the knitting yarn from dropping into the gap between the sinker and the sinker guide groove.

To achieve this object, the invention provides a sinker mechanism for a flat knitting machine, having at least a pair of needle beds, on which a plurality of knitting needles are slidably mounted in parallel, disposed oppositely in front and rear positions, wherein each needle bed is provided with sinkers capable of advancing, retreating and rocking with respect to the opening of the needle bed. A knitting yarn holding part is formed at the front end portion of each sinker. A sinker guide for guiding each sinker front end portion during swinging motion of the sinker is formed in the needle bed. A knitting yarn drop preventive part, for preventing the knitting yarn applied between the knitting needle and sinker from dropping into the gap between the sinker and sinker guide groove during knitting, is provided at the needle bed front end portion adjacent to the sinker.

Moreover, a support plate is laminated with a sinker on each needle plate mounted on the needle bed, and a front end of the support plate is extended to the front end portion of the needle bed, thereby forming the knitting yarn drop preventive part.

Furthermore, a front end portion of the knitting yarn drop preventive part formed on the support plate is extended to penetrate into a long groove formed in the longitudinal direction of the needle bed in the front end portion thereof.

Another feature of the invention is that the front end portion of the support plate penetrating into the long groove formed in the longitudinal direction of the needle bed is extended further by bending in the direction of the long groove so as to be orthogonal to the sliding surface of the corresponding knitting needle. The extended portion is bent before the sinker of the other side confronting the knitting needle so as to stand along the sinker, thereby forming the knitting yarn drop preventive part to be at opposite sides of the knitting needle.

Further, a part of the sliding surface of the knitting needle at the front end side of the needle bed including the needle bed front end portion is cut away, and the knitting yarn drop preventive part is formed along the sinker in the cut-away position, at least at one of the sides of the front end portion.

The knitting yarn drop preventive part can be formed integrally as part of the needle bed.

According to another feature of the invention, the knitting yarn guide part disposed above the knitting yarn drop preventive part is formed so as to be located above the knitting yarn holding part when the movable sinker swings and the knitting yarn holding part descends, being projected to the vicinity of the side of the middle position of the opening gap from the front end peripheral edge of the sinker plate overlapping with the knitting yarn guide surface. The portion forming the peripheral edge of the knitting yarn guide surface is formed in a shape covering the outside of the front end of the needle bed as viewed from the side. The knitting yarn guide surface is formed so that a terminal end thereof is formed at a height position of a tracing or line extending through the center of the hook of the knitting needle when it retreats on the needle bed, or at lower position.

In the sinker mechanism for a flat knitting machine according to the invention, the knitting yarn holding part is formed at the front end portion of the movable sinker. When the sinker swings forwardly, the knitting yarn holding part is made to swing into a deep position beneath the opening gap of the needle bed, and the loop of the former course is pushed in, and a new loop is formed.

For example, in the case of a knitting machine of fine gauge with a small needle pitch, or when the knitting needle is pulled in substantially with the sinker being pushed into a deep position, or in the case of forming a pattern so as to increase the tension of the knitting yarn applied between the knitting needle and the sinker, the knitting yarn is guided by the knitting yarn drop preventive part, and hence is held without being dropped into the gap between the sinker and sinker guide groove.

Furthermore, with a knitting yarn guide surface above the knitting yarn drop preventive part, when the knitting yarn is supplied into the hook of the adjacent knitting needle over the front end of the sinker, with the formed loop being stopped by the knitting needle, the yarn abuts against the knitting yarn guide surface projecting from the swing path of the movable sinker, and slides down on such surface. Thus, the knitting yarn is extended from the lower edge of the knitting yarn guide surface to a lower position of the yarn feeder, so as to be securely guided into the hook of the knitting needle, thereby preventing the yarn from passing above the hook of the knitting needle at the same time.

As described herein, the sinker mechanism for a flat knitting machine of the invention comprises a guide groove for guiding advancing, retreating and swinging movement of the sinker. The guide groove is disposed at the front end portion of the needle bed. The movable sinker with the knitting yarn holding part formed at the front end thereof is pushed into a deep position in the guide groove, while stopping the former loop, thereby forming a new loop, so that knitting is performed while sufficiently holding down the loop. Furthermore, for example, in the case of a knitting machine of fine gauge with a small needle pitch, or in the case that a knitting needle is pulled in substantially with the sinker being pushed into a deep position, or in the case of forming a pattern so as to increase the tension of the knitting yarn applied between the knitting needle and the sinker, the knitting yarn is guided by the knitting yarn drop preventive part. The yarn hence is held without being dropped into the gap between the sinker and sinker guide groove. Therefore, it is not necessary to dispose a wire in the longitudinal direction at the front end portion of the needle bed, and hence the hole for swinging motion in the inserted state of a wire into the sinker front end portion is not needed. Thus, the problem of sacrifice of strength of the sinker as experienced in the prior art arrangement will not occur.

By disposing the knitting yarn guide surface above the knitting yarn drop preventive part, the supplied yarn is guided downward by the knitting yarn guide surface. Therefore, the former loop can be sufficiently held down by the movable sinker, and hence even in the case of forming loops of loose stitches, it is beneficial to prevent over-stitching securely by accurately clearing the former loop from the latch.

Moreover, the knitting yarn supplied to the hook of the adjacent knitting needle over the front end of the sinker is prevented from sliding above from around the loop forming edge of the sinker, and the knitting yarn supplied to the knitting needle can be securely received on the hook. Hence, the loop is formed securely, and a knit fabric of high quality is formed.

BRIEF DESCRIPTION OF THE DRAWINGS

Other and further objects, features, and advantages of the invention will be made more explicit from the following detailed description taken with reference to the drawings wherein.

DETAILED DESCRIPTION OF THE PREFERRED EMBODIMENTS

Figure 1:
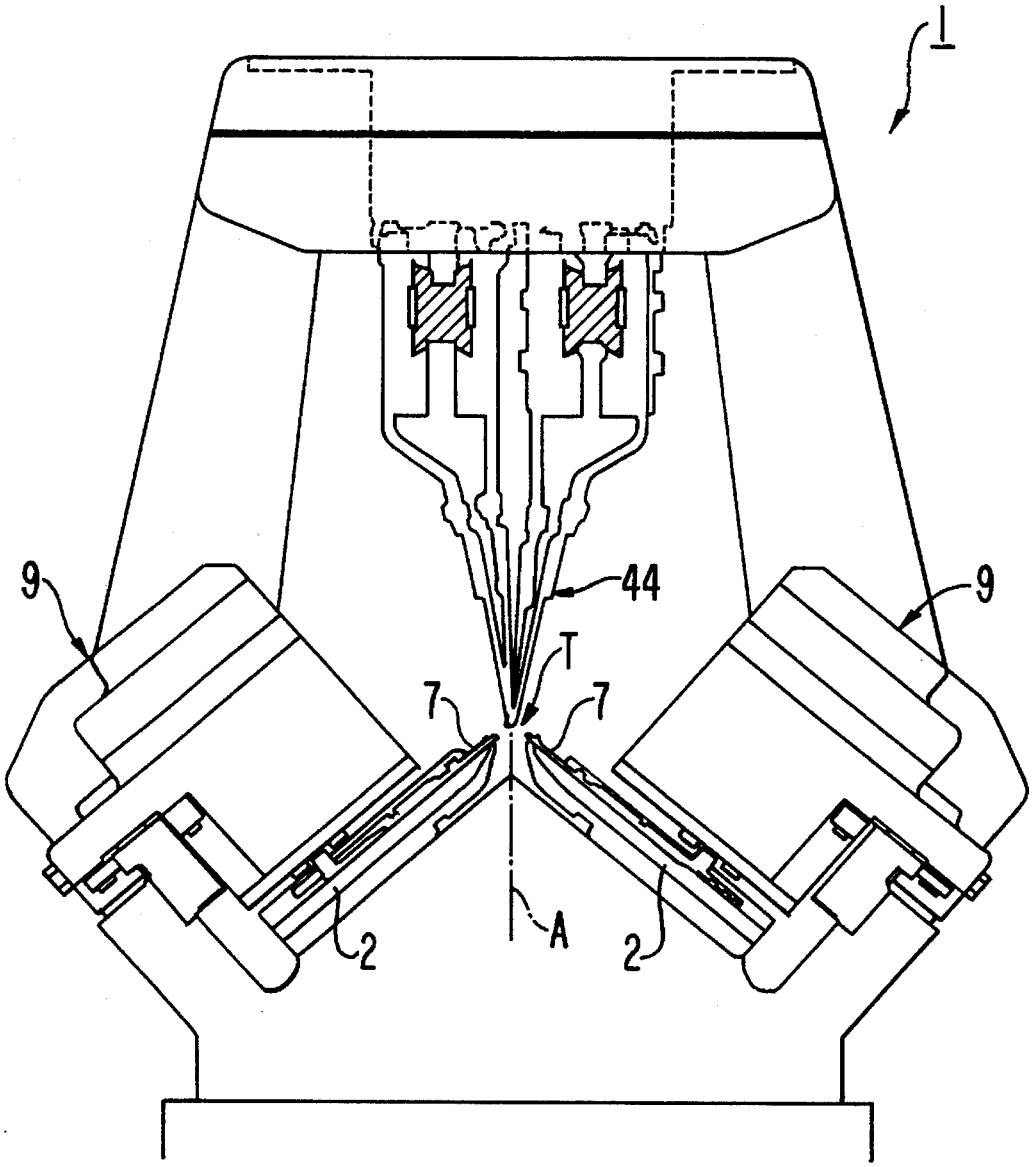
FIG. 1 is a side view of essential parts schematically showing a configuration of a flat knitting machine.

Now referring to the drawings, preferred embodiments of the invention are described below.

Figure 2:
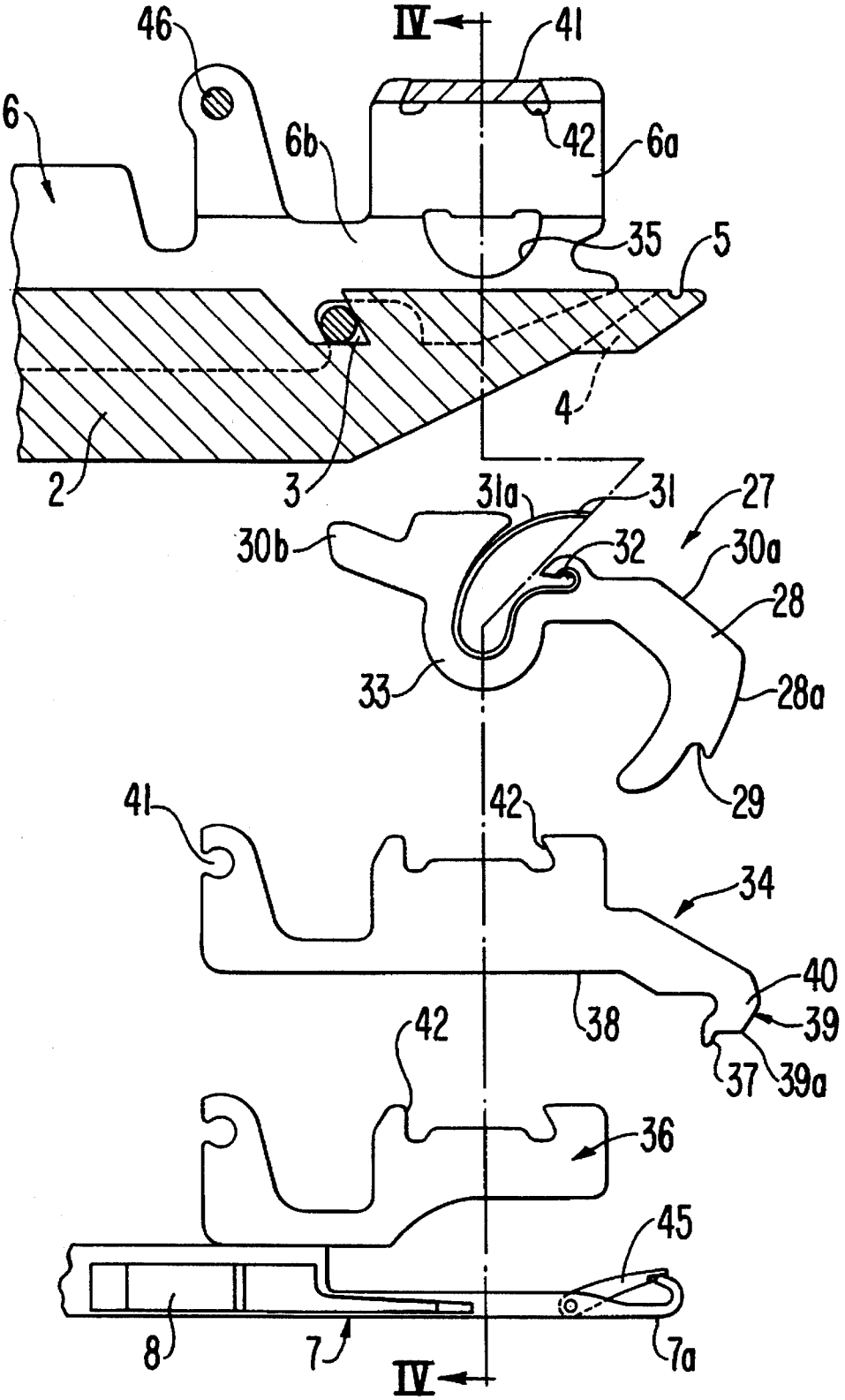
FIG. 2 is an exploded view of a sinker unit.

FIG. 1 is a side view showing a schematic constitution of a flat knitting machine, in which reference numeral 1 indicates a flat knitting machine as a whole. In such flat knitting machine 1, needle plates 6 as shown in FIG. 2 are disposed at equal intervals on needle beds 2. Plural latch type knitting needles 7, each having an elastic guide piece 8 for stitch transfer at a side surface, are disposed in parallel between needle plates 6 so as to be capable of forward and backward movement. At least a pair of the needle beds 2 are disposed in front and rear positions, in confronting positions across a line A, with front end portions of the respective knitting needles directed toward each other. At front end portions of the needle beds are disposed movable sinkers 27, described below. Guide grooves 4 guide the advancing, retreating and swinging movement of the movable sinkers 27 with respect to an opening. An opening gap T is formed between the front ends of the needle beds 2. Knitting yarn is supplied from a yarn feeder 44. Knitting needles 7 of the two needle beds 2 are caused to move forward and backward by respective carriages 9. It is assumed that the forward direction is the front side of the entire machine and the backward direction is the rear side thereof. In each needle bed 2, however, it is assumed that forward is the advancing direction of the knitting needles 7 and backward is the retreating direction thereof.

Figure 5:
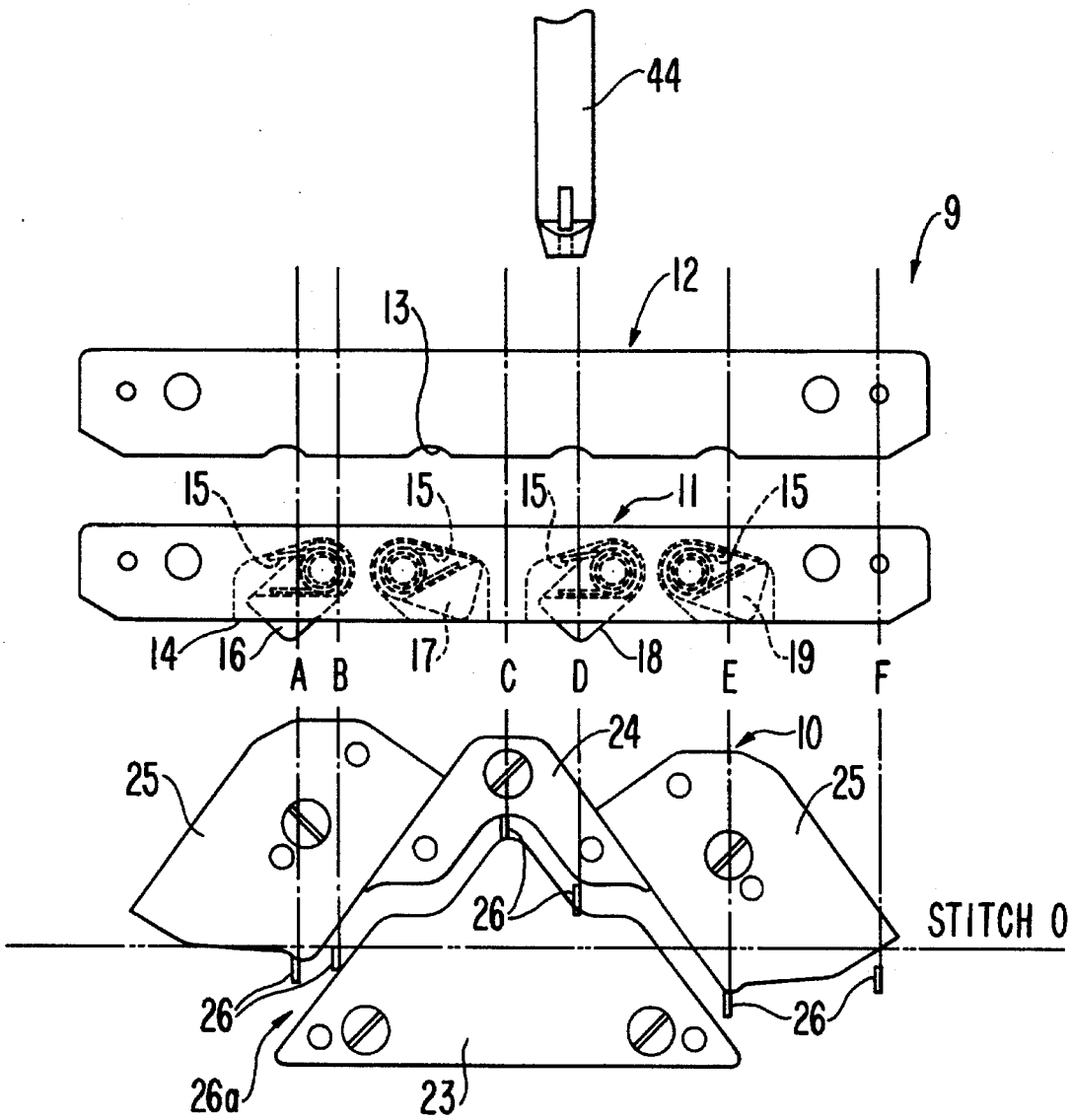
FIG. 5 is a schematic developed view showing the function of parts for controlling a knitting needle and sinker of a carriage.

FIG. 5 is an explanatory view showing the arrangement of a group of cams of the carriage 9 provided for imparting forward and backward motion of the knitting needles 7 of a respective needle bed 2 and for swinging the movable sinker 27 described below. Numeral 10 denotes a knitting cam, 11 is a rear cam for sinker control disposed ahead of the knitting cam 10, and 12 is a front cam for sinker control disposed ahead of the rear cam 11.

Figure 6:
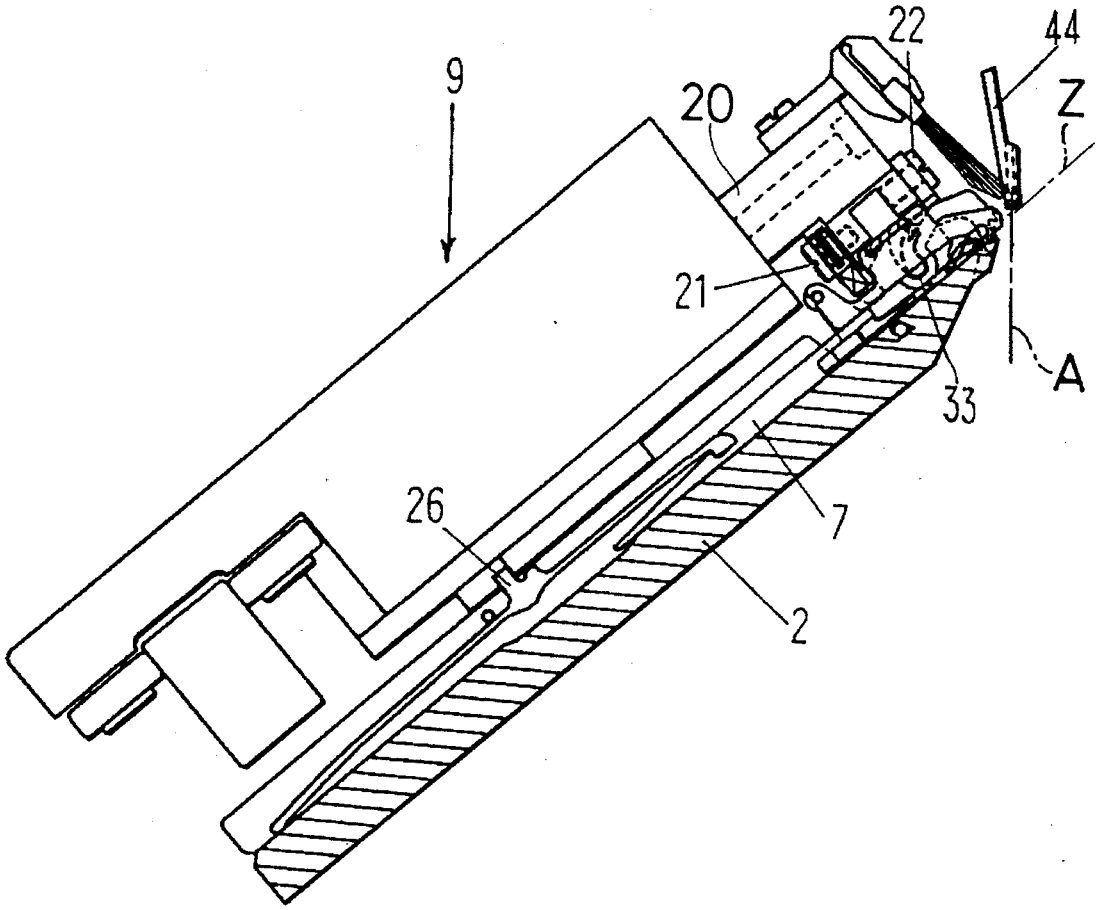
FIG. 6 is a side view of the sinker unit.

The front cam 12 for sinker control forms a cam profile 13 in a lower surface of one plate. The rear cam 11 for sinker control is composed by disposing movable cams 16, 17, 18, 19 urged by spiral springs 15 to project from a lower surface of a plate forming a cam profile 14. The front cam 12 and rear cam 11 for sinker control are respectively fixed by fixing bolts 22, 21 to a bracket 20 projecting from a carriage main body (FIG. 6). Of the movable cams 16, 17, 18, 19, the cams 16, 18 are for an outgoing stroke, and the cams 17, 19 at the other side are for a returning stroke.

The knitting cam 10 comprises a hill-shaped needle raising cam 23, a guard cam 24 disposed above the middle of the needle raising cam 23, and stitch cams 25 disposed slidably along the side surfaces at opposite sides of the guard cam 24. A control groove **26*a*, in pass butts 26 of the knitting needles 7, is formed between the needle raising cam 23, guard cam 24 and stitch cams 25**.

As shown in FIG. 2, the needle plate 6 is mounted on top surface of the needle bed 2. The knitting needles 7 controlled by the knitting cam 10 are slidably disposed between the needle plates 6 for movement between positions such that hooks **7*a* at the front ends of needles 7 project outward from the front end of the needle bed 2 and positions such that hooks 7*a* are drawn in. The movable sinker 27 is mounted on the needle plate 6, and a spacer 36 is disposed above each knitting needle 7. The hook 7*a* of each needle is opened and closed by a latch 45** thereof.

Figure 3A:
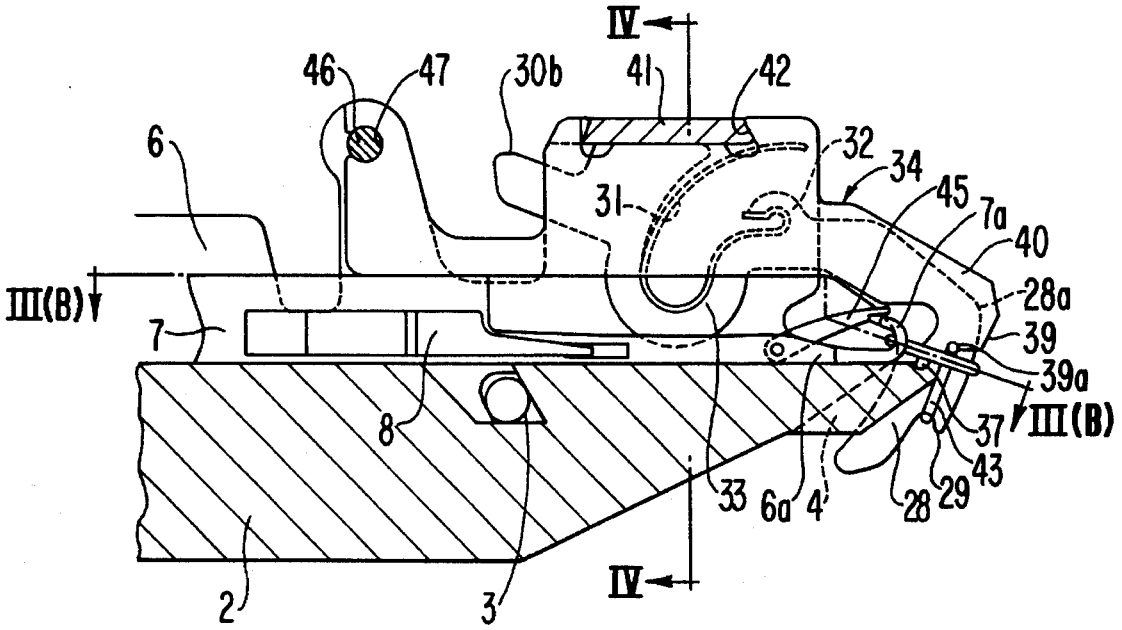
FIG. 3(A) is a side view of the sinker unit.
Figure 3B:
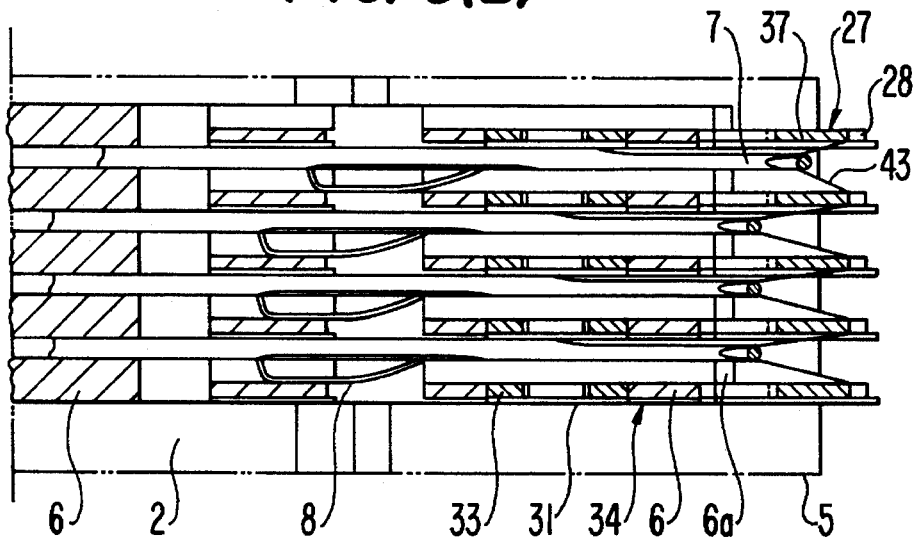
FIG. 3(B) is a sectional view taken along line III(B)—III(B) in FIG. 3(A).

FIG. 3(A) specifically shows a sinker 27, and FIG. 3(B) shows the sinkers in section. Each movable sinker 27, as shown in FIG. 2 and FIGS. 3(A), 3(B), includes a sinker plate 28 formed of a thin plate. Plate 28 is installed together with a support plate 34 between the needle plate 6 and spacer 36 disposed above the knitting needle 7. Swinging movement of movable sinker 27 mainly is controlled by front cam 12 and rear cam 11.

At the front end of the sinker plate 28 is formed a knitting yarn holding part 29 for receiving the knitting yarn. Slightly behind the knitting yarn holding part 29 is formed a front cam abutting part **30*a* against which abuts the front cam 12. Near the front cam abutting part 30*a* is formed a spring stopping or holding part 32 for supporting an end of a wire spring 31 of an approximately U shape for pushing down and thrusting the knitting yarn holding part 29**.

Behind the spring stopping part 32 of the sinker plate 28 is formed a rotary pivot part 33 projecting downwardly in the shape substantially of a semicircle. At a rear end portion of plate 28 is formed a rear cam abutting part **30*b* against which abuts the rear cam 11**.

The needle plate 6 on which the sinker plate 28 is mounted is formed to have a thin wall **6*a* by cutting away an upper half of one side of the portion closest to the front end, by an amount equal to the sum of the thickness of the sinker plate 28 and support plate 34. In a middle position of the portion 6*a* at a lower half 6*b* of the thickness is formed a semicircular recess 35 forming a bearing. The rotary pivot part 33 is supported in the recess 35, and sinker 27 is capable of swinging about such bearing in a narrow space formed by the thin wall part of the needle plate 6 and the support plate 34**.

The support plate 34 is formed of a thin steel plate, and the rear end portion thereof has a recess 47 into which fits a rotary pivot rod 46 supported by penetrating through the needle plates 6. A dovetail engaging groove 42, discussed below, is formed in a middle portion of plate 34 and is formed nearly in the same shape as a similar groove in spacer 36. A knitting yarn drop preventive part 37 projects downwardly from a forward portion of plate 34. The front end of knitting yarn drop preventive part 37 fits into an elongated groove 5 formed in the needle bed 2 in the longitudinal direction thereof. A stitch loop stopped by the knitting needle 7 is prevented from falling into a gap between the movable sinker 27 disposed adjacent to the knitting needle 7 and the sinker guide groove 4.

In this embodiment, penetration of the front end portion of the knitting yarn drop preventive part 37 into the groove 5 is advantageous in that the front end of the knitting yarn drop preventive part 37 is supported securely when knitting a thick knitting yarn, as in a coarse gauge knitting machine, or when applying a large tension to the knitting yarn.

Figure 8:
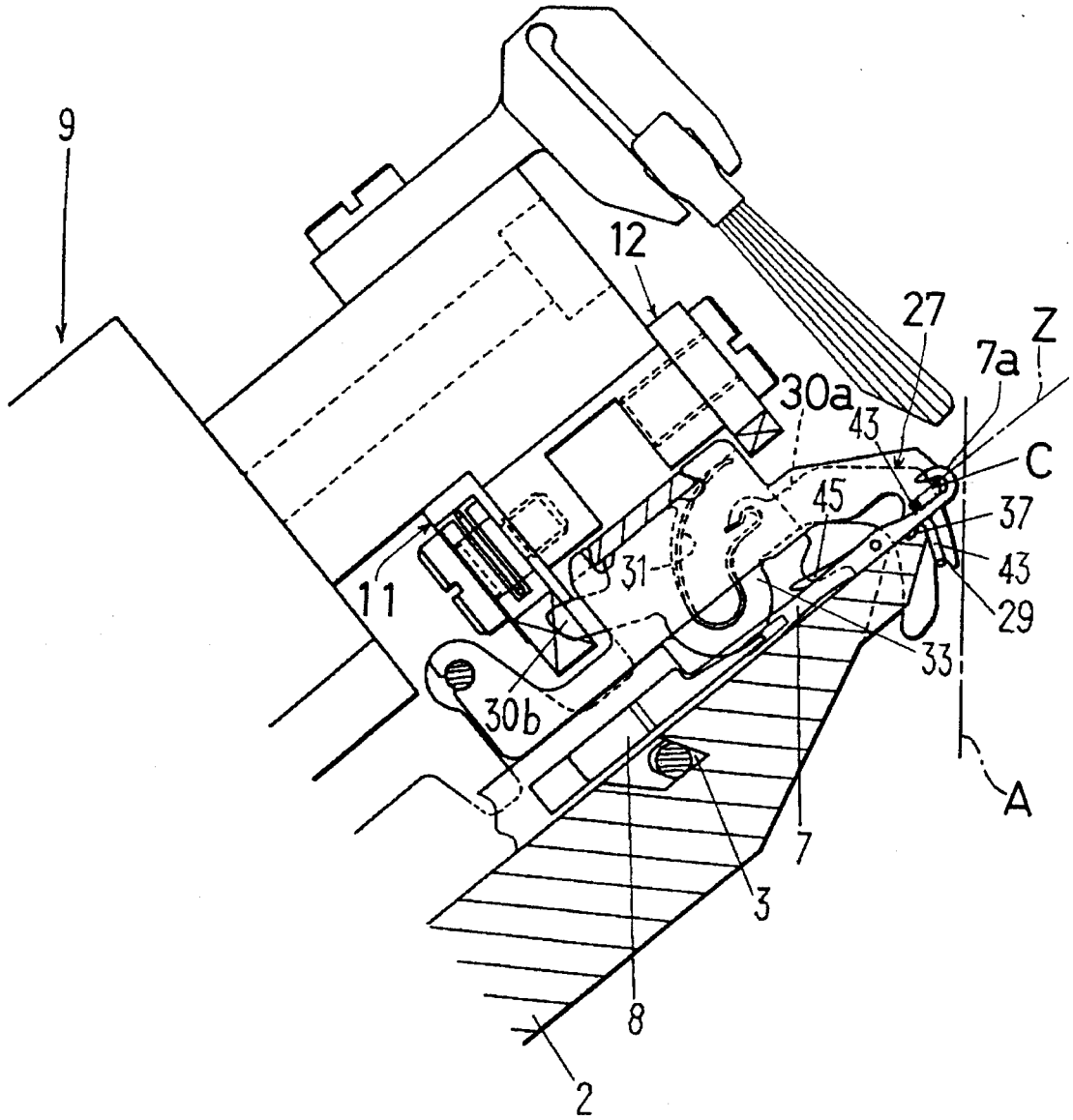
FIG. 8 is a side view of the sinker unit when the sinker is at position B shown in FIG. 5.

A knitting yarn guide 40 is formed adjacent the opening gap T, above the knitting yarn drop preventive part 37. Knitting yarn guide 40 projects obliquely downwardly from the bottom 38 of the support plate 34. The front end portion of the support plate 34 has a knitting yarn guide surface 39 close to the middle position A of the opening gap T between the needle beds 2 shown in FIG. 1, and is formed to project from an arc-shaped front end surface **28*a* of the sinker plate 28. Knitting yarn guide surface 39 is formed, as shown in FIG. 8, so that a terminal end portion 39*a* is located at the height position of the trace or path Z of the center C of the hook 7*a* when the knitting needle 7 retreats along the needle bed 2**.

Figure 4:
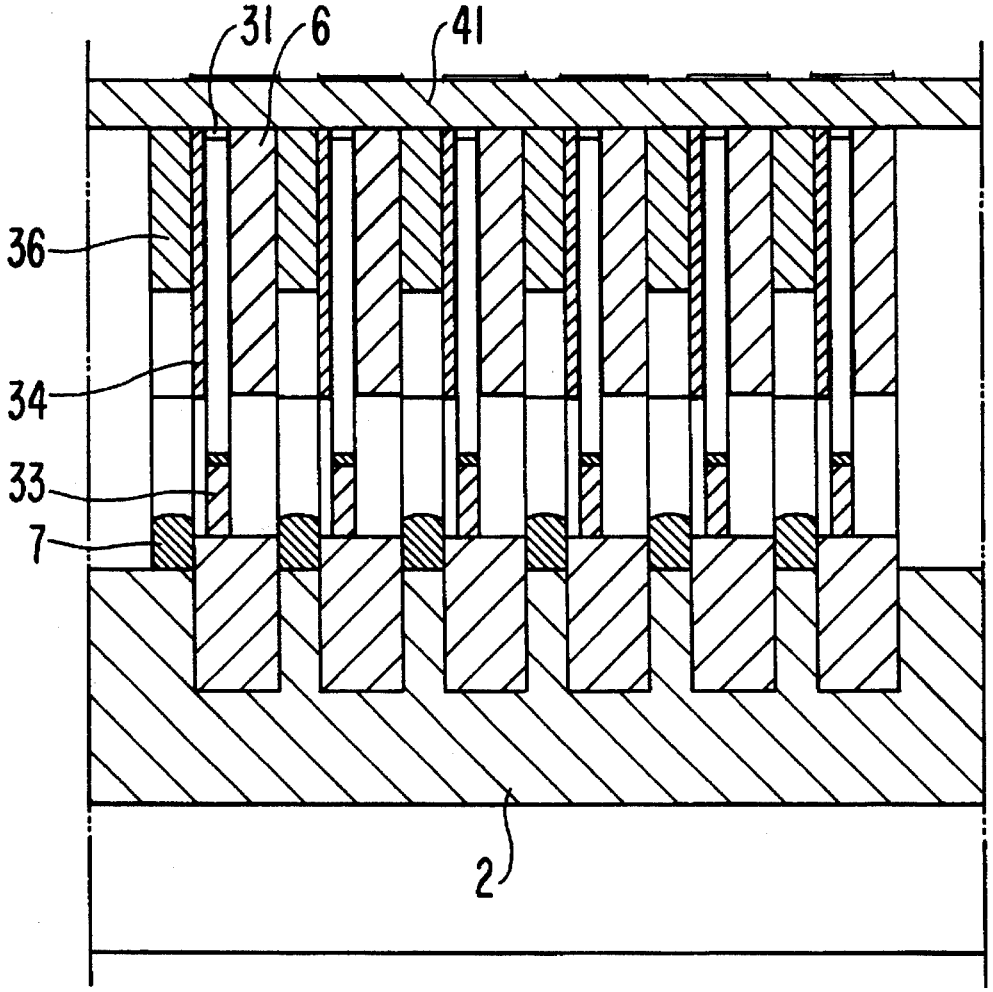
FIG. 4 is a sectional view taken along lines IV—IV in FIGS. 2 and 3(A).

FIG. 4 shows a holder plate 41 inserted into engaging grooves 42 formed in each of top surfaces of needle plate 6, spacer 36 and support plate 34, thereby fixing or holding down the spacer 36 and support plate 34. At the same time, a lower surface of the holder plate 41 pushes down a free end portion **31*a* of the wire spring 31, and the knitting yarn holding part 29 at the front end of the sinker plate 28** is always urged downwardly.

In the thus composed flat knitting machine, the operation of the sinker mechanism is described below.

Figure 7:
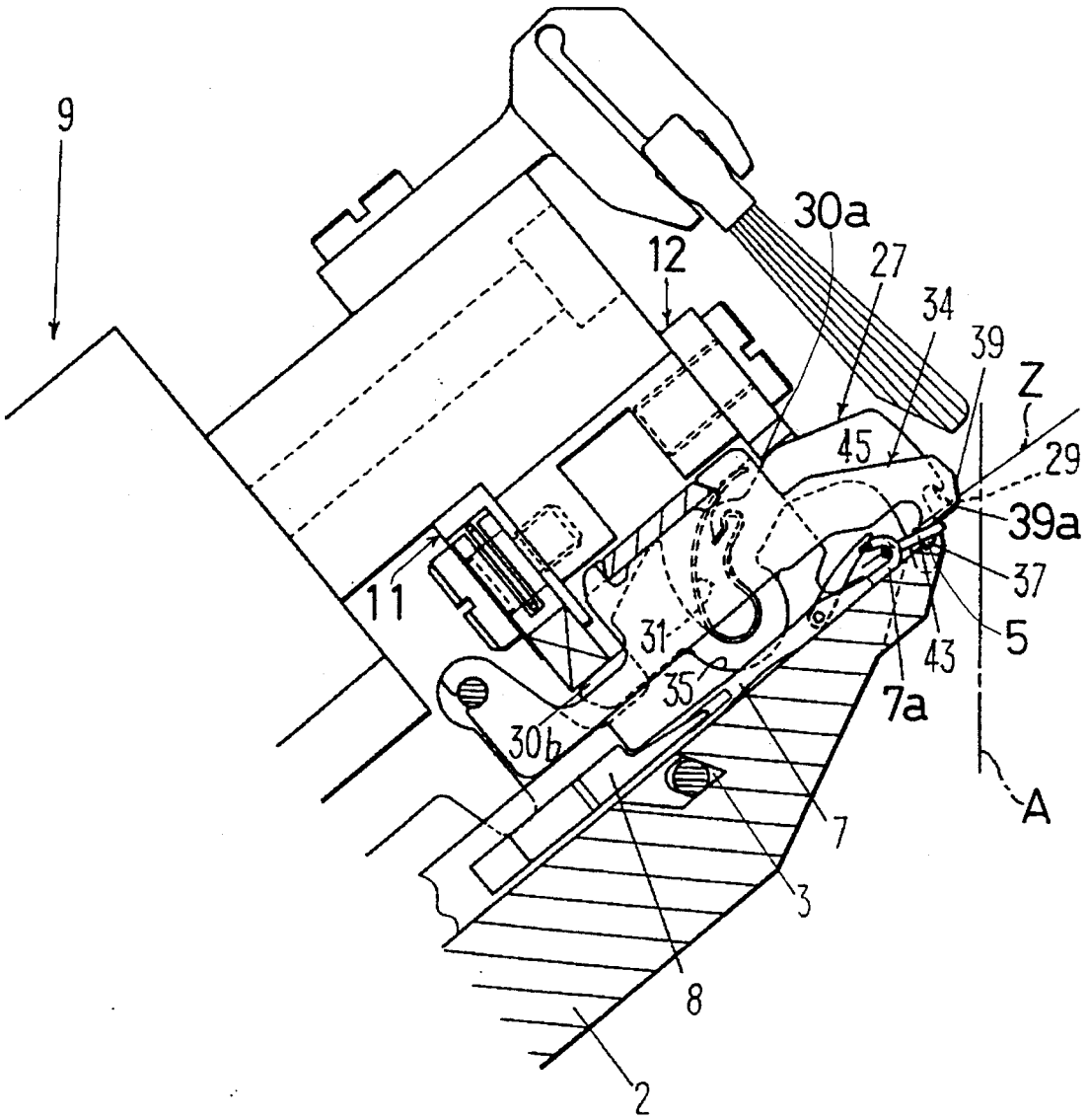
FIG. 7 is a side view of the sinker unit when the sinker is at position A shown in FIG. 5.

In FIG. 5. by moving the carriage 9 from right to left, when a movable sinker 27 comes to the position A shown therein, with the knitting needle 7 drawn in from the front end of the needle bed 2 as shown in FIG. 7, the movable sinker 27 abuts with front cam abutting part **30*a* thereof against the front cam 12, and the rear cam abutting part 30*b* is pushed down by the movable cam 16 of the rear cam 11. The sinker plate 28 rotates counterclockwise about the center of rotation of the rotary pivot part 33 fitting into recess 35, and the knitting yarn holding part 29 at the front end of the sinker plate 28 is positioned above the knitting needle 7**.

When the movable sinker 27 comes to position B in FIG. 5, as shown in FIG. 8, the butt 26 is slightly pushed up by the needle raising cam 23, and the hook **7*a* of the knitting needle 7 is slightly projected from the front end of the needle bed 2. On the other hand, the movable sinker 27 rotates clockwise by the elastic force of the wire spring 31, and is pushed downward of the knitting needle 7, with knitting yarn 43 of a former loop held in the knitting yarn holding part 29**.

Figure 9:
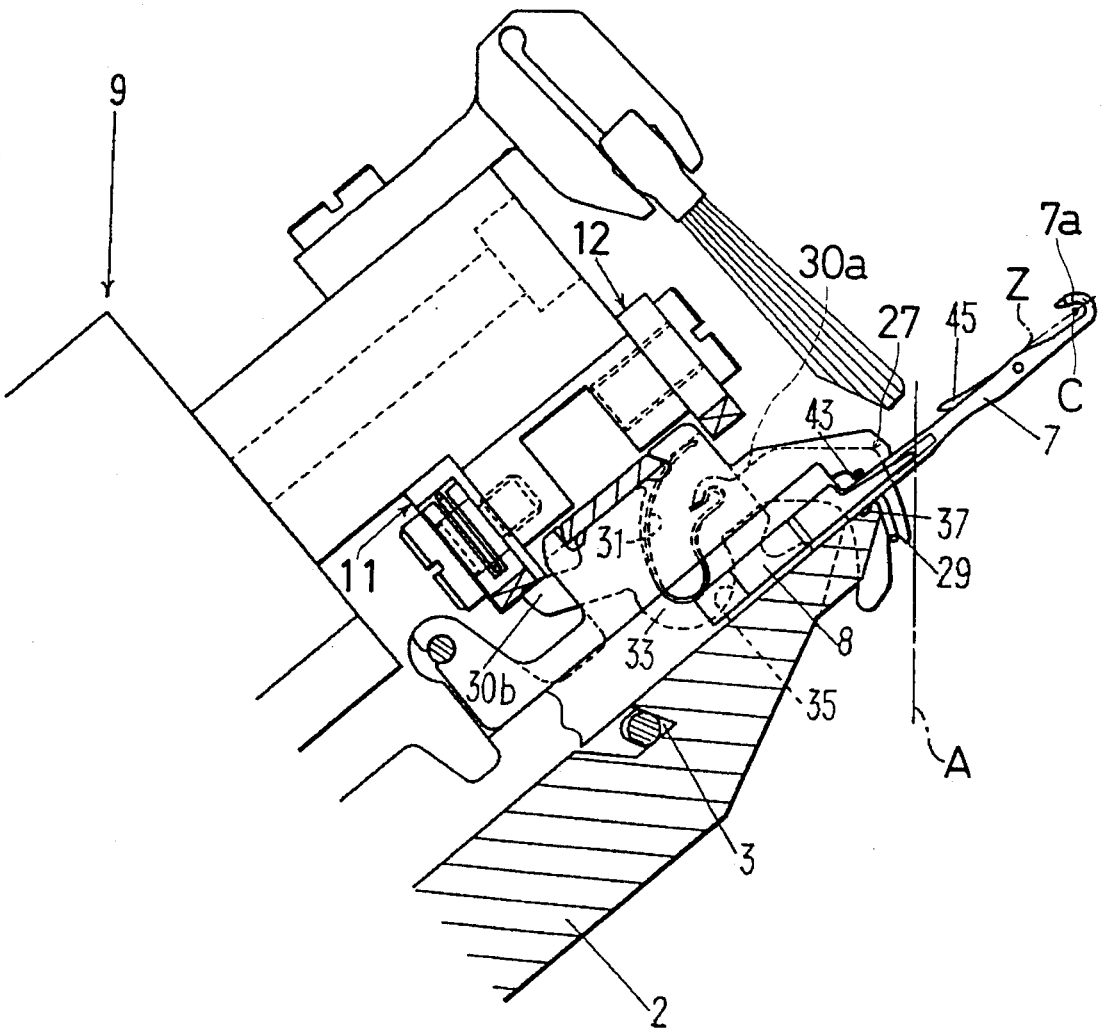
FIG. 9 is a side view of the sinker unit when the sinker is at position C shown in FIG. 5.

As the carriage 9 further moves leftward until the sinker 27 comes to the position C in FIG. 5, the butt 26 of the knitting needle 7 is pushed up substantially to the peak of the needle raising cam 23, and the hook 7*a* is substantially projected from the front end of the needle bed 2 as shown in FIG. 9. In a balanced state of tension of the knitting yarn 43 of the former loop arrested on the knitting yarn holding part 29 at the front end and the elastic force of the wire spring 31, the wire spring 31 is held in detent part 32, and the knitting yarn 43 of the former loop rides over and pushes open the latch 45 of the hook 7*a*. At this time, if the tension of the knitting yarn 43 of the former loop arrested on the knitting yarn holding part 29 is elevated, depending on the amount of such tension, the knitting yarn holding part 29 rocks upward to absorb such tension, so that the tension of the knitting yarn 43 of the former loop arrested on the knitting yarn holding part 29 is maintained approximately at a specified tension.

Figure 10:
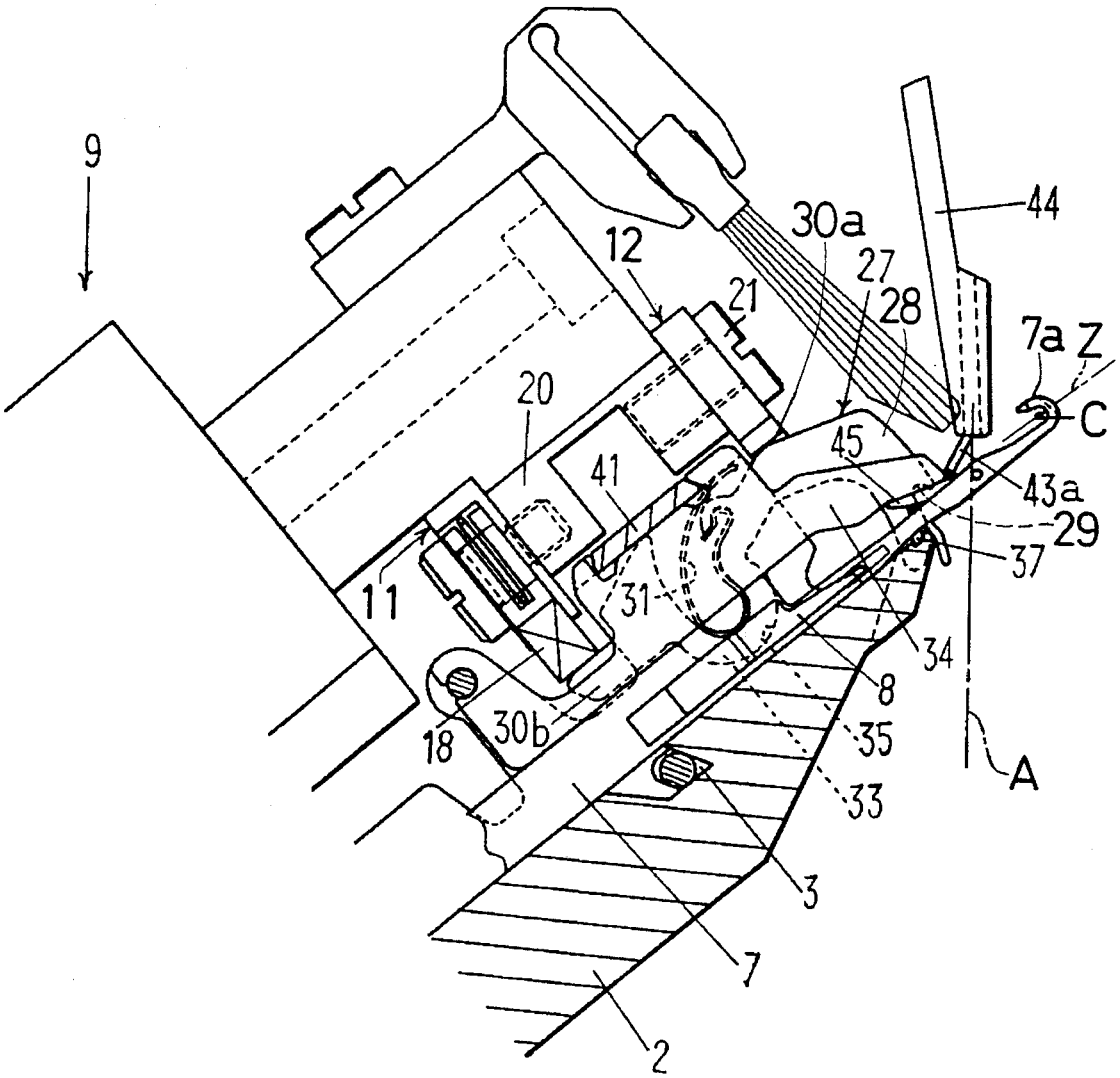
FIG. 10 is a side view of the sinker unit when the sinker is at position D shown in FIG. 5.

As the carriage 9 further moves leftward until the movable sinker 27 comes to position D in FIG. 5, as shown in FIG. 10, with knitting yarn 43*a* supplied from a yarn feeder 4 engaged with the hook 7*a* of the knitting needle 7, the butt 26 of the knitting needle 7 shown in FIG. 5 is pushed down by the guard cam 24. At this time, the movable sinker 27 rotates counterclockwise about the center of rotation of the rotary pivot part 33 as the rear cam abutting part 30*b* of the sinker plate 28 is pushed down by the movable cam 18 of the rear cam 11, and the knitting yarn holding part 29 at the front end of the sinker plate 28 climbs up nearly to the knitting needle 4. Therefore, the knitting yarn 43 of the former loop is released from the hook 7*a*, thereby moving into a knock-over waiting position outside the latch 45.

Figure 11:
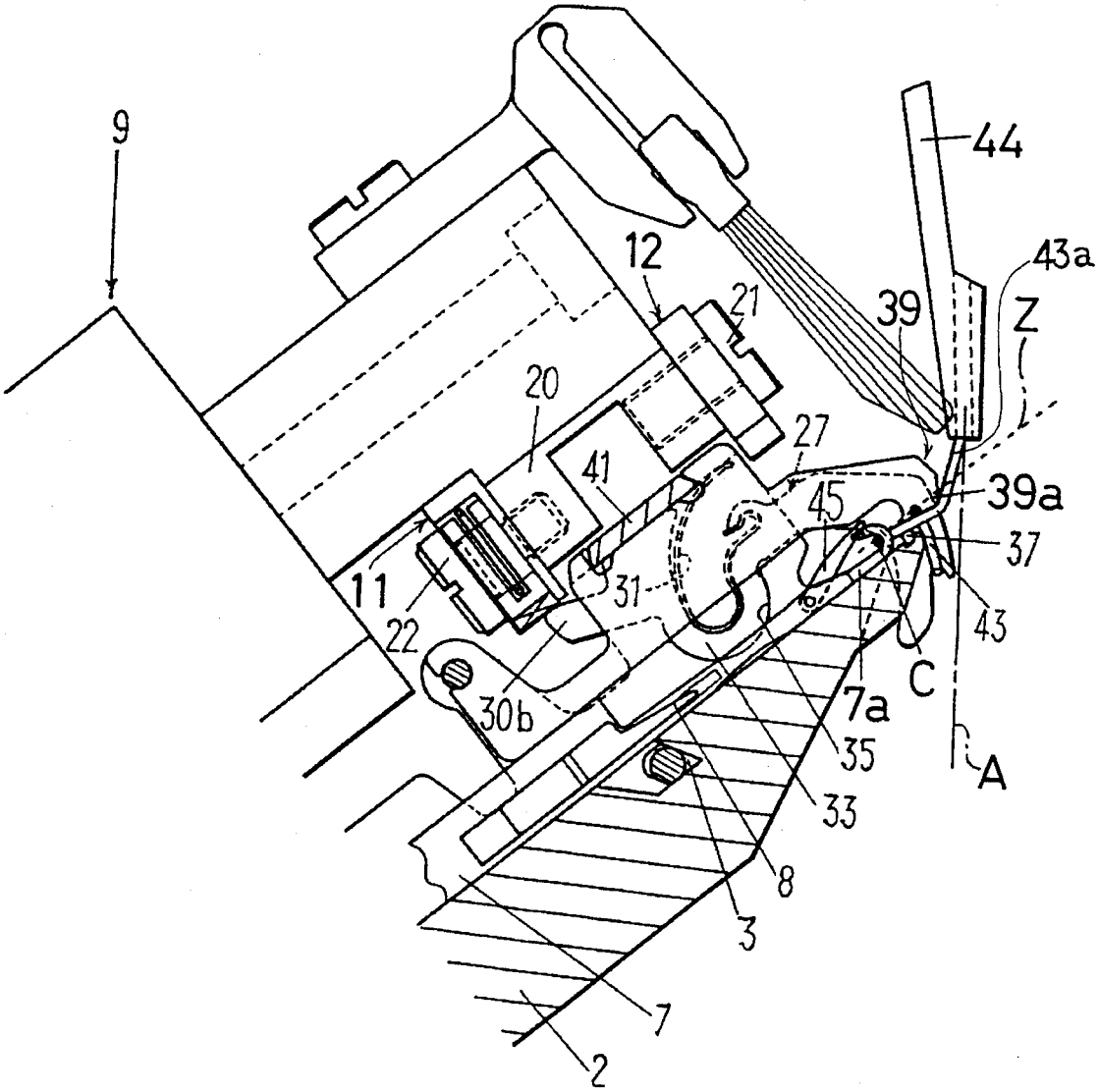
FIG. 11 is a side view of the sinker unit when the sinker is at position E shown in FIG. 5.

When the sinker 27 is at position E in FIG. 5, the butt 26 of the knitting needle 7 is further pushed down by the stitch cam 25, and the latch 45 is closed, the knitting yarn 43 of the former loop is knocked over, and the hook 7*a* is withdrawn into the front end of the needle bed 2 (see FIG. 11). Herein, the knitting yarn 43*a* sequentially supplied from the yarn feeder 44 to the hook 7*a* of the adjacent hitting needle 7 over the front end of the movable sinker plate 27 abuts against the knitting yarn guide surface 39 formed at the front end portion of the support plate 34, and slides down on surface 39 to the position (the height position of the trace or path Z of the center C of the hook 7*a* of the knitting needle 7) of its terminal end portion 39*a*. Thus, the knitting yarn 43*a* extends from this low position to the yarn feeder 44, thereby securely feeding the yarn to the hook 7*a* of the next knitting needle 7 relative to the running direction of movement of the carriage 9.

In the process of transferring from the position of D to the position of E, along with the advancing and retreating action of the knitting needles 7, the knitting yarn 43 of the former loop rides over the latch 45 of the hook 7*a* and closes the latch 45, and it is knocked over by riding over the top surface of the closed latch 45. The loop to be knocked over is largely extended when the hook 7*a* passes through it. Therefore, the tension of the knitting yarn 43 of the former loop arrested on the knitting yarn holding part 29 at the front end of the sinker plate 27 will be abnormally high. With this abnormally high tension resisting the elastic thrusting force of the wire spring 31, the sinker plate 28 rotates counterclockwise about the center of rotation of the rotary pivot part 33 to relax the high tension, so that the tension of the knitting yarn 43 detected on the knitting yarn holding part 29 can be maintained nearly at the specified tension.

At the position of D shown in FIG. 10, for example, with the rear cam abutting part 30*b* of the sinker 27 pushed into a deep position by cam 18, the knitting needle 7 is largely pulled in, and the tension of the knitting yarn 43 applied between the knitting needle 7 and the sinker 27 is heightened. The knitting yarn 43 easily would move into the guide groove 4 for guiding the movable sinker 27 to advance, retreat and swing with respect to the opening, but since it is guided by the knitting yarn drop preventive part 37 standing in the way of such movement, such yarn is prevented from moving into the gap between the sinker 27 and sinker guide groove 4. Therefore, it is possible to prevent inconveniences such as dropping and cutting of the knitting yarn 43 in the groove 4.

Figure 12:
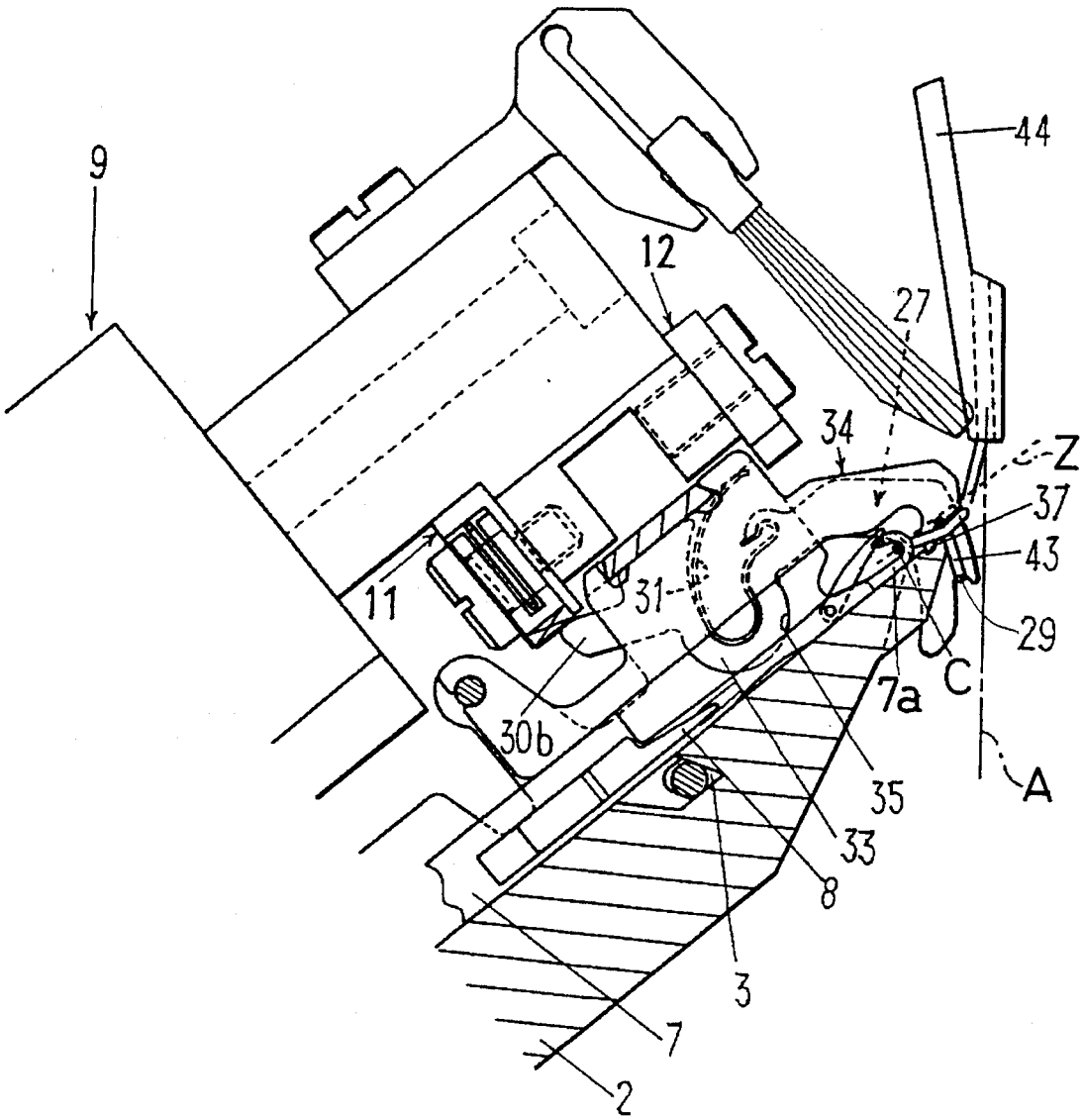
FIG. 12 is a side view of the sinker unit when the sinker is at position F shown in FIG. 5.

When the carriage 9 further moves leftward until the movable sinker 27 reaches the position F in FIG. 5, the butt 26 of the knitting needle 7 is slightly raised from the position of E by the bottom of the stitch cam 25. Accordingly, as shown in FIG. 12, the hook 7*a* of the knitting needle 7 slightly advances to the front end side of the needle bed 2, attempting to loosen the knitting yarn 43 of the former loop engaged with the hook 7*a*. However, the knitting yarn holding part 29 is pushed downwardly by the elastic force of the wire spring 31, thereby preventing such yarn from loosening. Therefore, skipping of a stitch due to loosening of the knitting yarn 43 of the former loop engaged with the hook 7*a* is avoided.

This embodiment includes support plate 34 forming the knitting yarn drop preventive part 37 at only one of the sinkers 27 positioned on opposite sides of the knitting needle 7. As shown in FIG. 3(B), knitting needle 7 has the elastic guide piece 8 on the side surface. The side of the needle plate 6 confronting the elastic guide piece 8 is blocked and a space for accommodation is provided. Therefore, the knitting needle 7 itself is at a position shifted in a direction opposite from the side of the guide piece 8. Thus, the angle formed by the knitting yarn 43 applied between the knitting needle 7 and the sinker 27 and the sinker plate 28 is different on opposite sides of the needle. Therefore, the knitting yarn 43 is provided only at the side smaller with the angle which more easily falls into the guide groove 4. A support plate 34 with a knitting yarn drop preventive part 37 may be disposed at both sides of each sinker plate 28, since such arrangement advantageously provides a knitting yarn drop preventive parts 37 on both sides of a needle.

Figure 13:
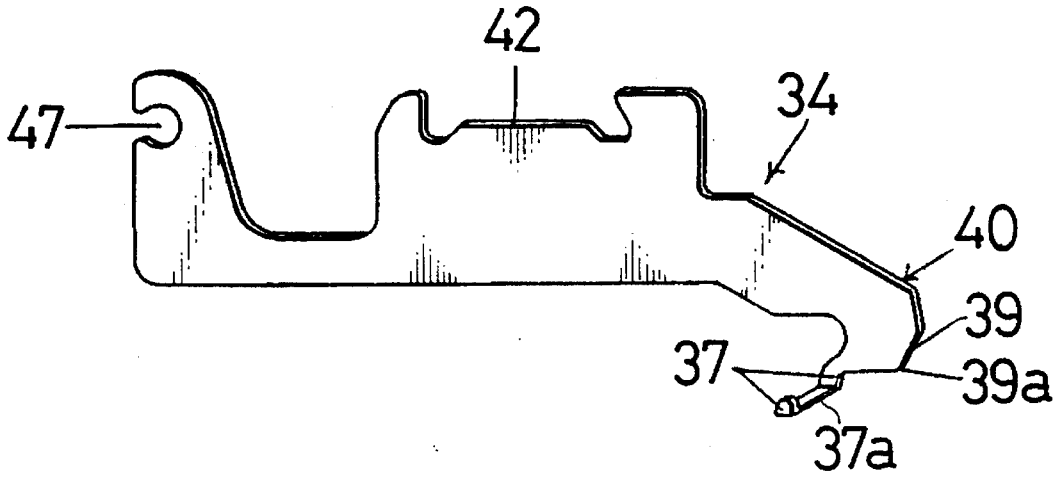
FIG. 13 is a perspective view showing another embodiment of the invention.

As shown in FIG. 13, a front end portion of the support plate 34 fixed on the needle bed 2 can be further bent and extended so as to fit in groove 5 and to be orthogonal to the sliding surface of the corresponding knitting needle 7. The extended part 37*a* may be set up along the sinker 27 before the sinker 27 of the confronting knitting needle 7 on the other side. The knitting yarn drop preventive part 37 may be formed at both sides of the knitting needle 7 by use of one support plate 34. Alternatively, by cutting away a front end portion of the needle bed instead of the groove 4, the front end of the knitting yarn drop preventive part 37 may be positioned in such cut-away area.

Figure 14:
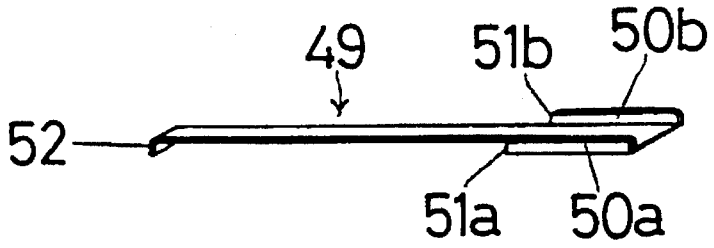
FIG. 14 is a perspective view showing another embodiment of the invention.
Figure 15A:
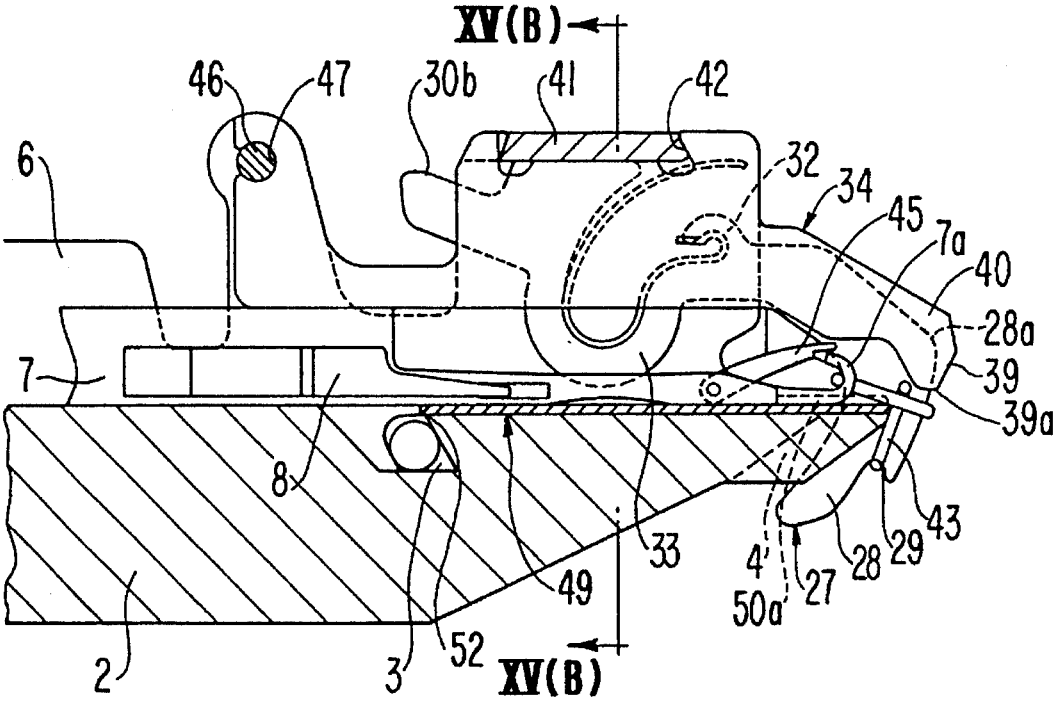
FIG. 15(A) is a side view of the sinker unit in the embodiment of the invention shown in FIG. 14.
Figure 15B:
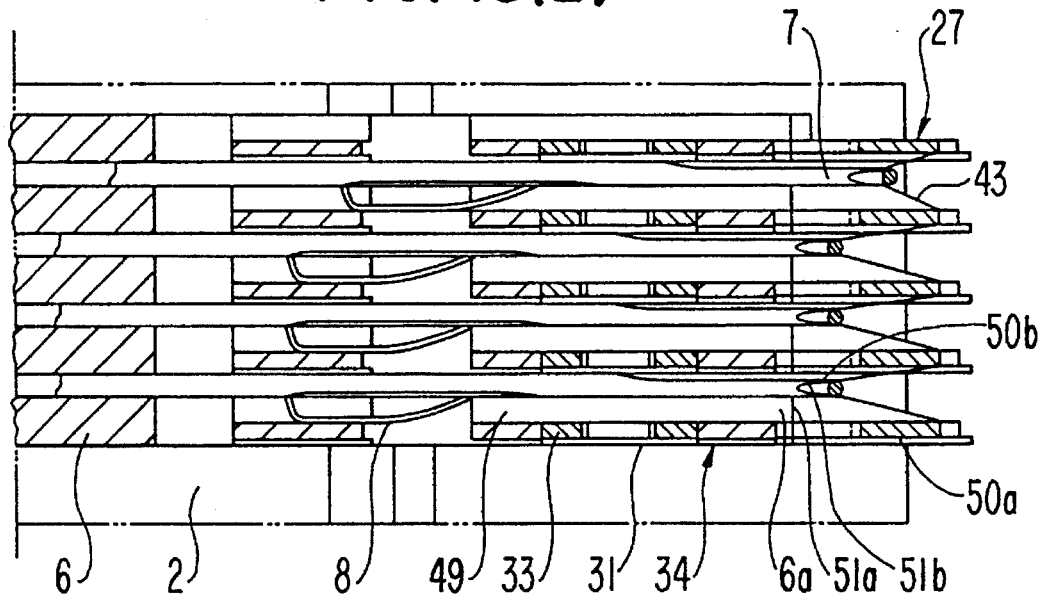
FIG. 15 (B) is a sectional view taken along line XV(B)—XV(B) in FIG. 15 (A).

In the embodiment of the invention shown in FIGS. 14–15(B), a part of the knitting needle sliding surface at the front end side of the needle bed 2, including the front end of the needle bed 2, is cut away. In such cut-away area, part of the sliding surface of the knitting needle are side parts of a front end portion of a support member 49 disposed on the needle bed 2 that are bent laterally so as to be adjacent to the sinker plate 28. Such bent portions form knitting yarn drop preventive parts 50*a* and 50*b* disposed at opposite sides. In order that the support member 49 not slip out of the needle bed due to moving or floating during operation of the knitting machine, a tail of the support member 49 is bent the direction of the groove to form an engaging part 52 engaged with groove 3 extending in the longitudinal direction of the needle bed. Rear end surfaces 51*a* and 51*b* of the knitting yarn drop preventive parts 50*a* and 50*b* at the front end portion of the support member 49 are caused to abut against upper portion of the needle plate, thereby fixing the position of support member 49.

Figure 16:
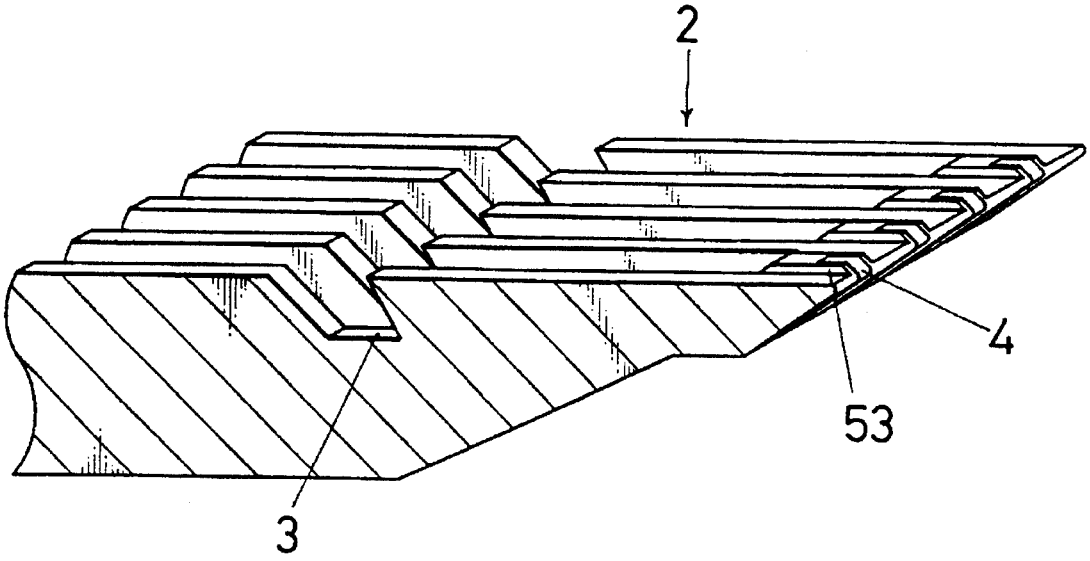
FIG. 16 is a perspective view of a knitting yarn drop preventive part in a further embodiment of the invention.

According to a further embodiment of the invention shown in FIG. 16, a portion of the front end of the needle bed 2 adjacent guide groove 4 may be formed of an increased height. Such higher portion may be a knitting yarn drop preventive part 53 formed integrally as a part of the needle bed 2.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A flat knitting machine assembly comprising:

at least a pair of needle beds aligned with front ends thereof confronting each other with a gap therebetween;

each said needle bed having a plurality of parallel knitting needles mounted for sliding advancing movement toward said gap and sliding retreating movement away from said gap;

each said needle having associated therewith a sinker that is mounted for swinging movement such that a knitting yarn holding part at a front end portion of said sinker is movable toward and away from said gap;

said front end of each said needle bed having formed therein sinker guide grooves for guiding swinging movement of respective said front end portions of said sinkers; and each said front end portion of each said needle bed having knitting yarn drop preventing means for preventing knitting yarn between each said needle and the respective said sinker from dropping into a space defined between said respective sinker and the respective said sinker guide groove.

2. An assembly as claimed in claim 1, further comprising a member defining a knitting yarn guide surface at a position above said knitting yarn preventing means for each said sinker, said knitting yarn guide surface projecting into said gap beyond a path of movement of a front peripheral edge of said each sinker during swinging movement thereof, and said knitting yarn guide surface having a lower peripheral edge located at a position below a path of movement of a center of a hook of the respective said needle during said advancing and retreating movement thereof.

3. An assembly as claimed in claim 1, further comprising a plurality of parallel needle plates mounted on each said needle bed, each said needle plate having mounted thereon a respective support plate, each said support plate having a front end portion extending to said front end of the respective said needle bed and defining said knitting yarn drop preventing means for a respective said needle and sinker.

4. An assembly as claimed in claim 3, wherein each said support plate defines a knitting yarn guide surface at a position above said knitting yarn preventing means for each said sinker, said knitting yarn guide surface projecting into said gap beyond a path of movement of a front peripheral edge of said each sinker during swinging movement thereof, and said knitting yarn guide surface having a lower peripheral edge located at a position below a path of movement of a center of a hook of the respective said needle during said advancing and retreating movement thereof.

5. An assembly as claimed in claim 3, wherein each said needle bed has formed in said front end thereof an elongated groove extending in a direction that is longitudinal of said needle bed and that is orthogonal to the direction of movement of said needles, and said front end portion of each said support plate extending into said elongated groove.

6. An assembly as claimed in claim 5, wherein each said support plate defines a knitting yarn guide surface at a position above said knitting yarn preventing means for each said sinker, said knitting yarn guide surface projecting into said gap beyond a path of movement of a front peripheral edge of said each sinker during swinging movement thereof, and said knitting yarn guide surface having a lower peripheral edge located at a position below a path of movement of a center of a hook of the respective said needle during said advancing and retreating movement thereof.

7. An assembly as claimed in claim 5, wherein said front end portion of each said support plate extending into said groove is elongated in the direction of said groove to extend to opposite sides of the respective said needle.

8. An assembly as claimed in claim 3, wherein each said support plate defines a knitting yarn guide surface at a position above said knitting yarn preventing means for each said sinker, said knitting yarn guide surface projecting into said gap beyond a path of movement of a front peripheral edge of said each sinker during swinging movement thereof, and said knitting yarn guide surface having a lower peripheral edge located at a position below a path of movement of a center of a hook of the respective said needle during said advancing and retreating movement thereof.

9. An assembly as claimed in claim 1, wherein a portion of each said needle bed defining a sliding surface for each respective said needle is cut away adjacent said front end of said needle bed, and said knitting yarn drop preventing means comprises a support member fitted in said cut away portion and extending laterally of at least one side of the respective said sinker.

10. An assembly as claimed in claim 9, wherein said support member extends laterally of both opposite sides of said respective sinker.

11. An assembly as claimed in claim 9, further comprising a member defining a knitting yarn guide surface at a position above said knitting yarn preventing means for each said sinker, said knitting yarn guide surface projecting into said gap beyond a path of movement of a front peripheral edge of said each sinker during swinging movement thereof, and said knitting yarn guide surface having a lower peripheral edge located at a position below a path of movement of a center of a hook of the respective said needle during said advancing and retreating movement thereof.

12. An assembly as claimed in claim 1, wherein said knitting yarn drop preventing means is formed integrally with said needle bed as a part thereof.

13. An assembly as claimed in claim 12, wherein said knitting yarn drop preventing means comprises raised portions of said front end of said needle bed adjacent respective said sinker guide grooves.

14. An assembly as claimed in claim 12, further comprising a member defining a knitting yarn guide surface at a position above said knitting yarn preventing means for each said sinker, said knitting yarn guide surface projecting into said gap beyond a path of movement of a front peripheral edge of said each sinker during swinging movement thereof, and said knitting yarn guide surface having a lower peripheral edge located at a position below a path of movement of a center of a hook of the respective said needle during said advancing and retreating movement thereof.

* * * * *